US007905634B2

(12) United States Patent
Agurok et al.

(10) Patent No.: US 7,905,634 B2
(45) Date of Patent: Mar. 15, 2011

(54) MULTI-REFLECTOR LED LIGHT SOURCE WITH CYLINDRICAL HEAT SINK

(75) Inventors: Ilya Agurok, Torrance, CA (US); Waqidi Falicoff, Stevenson Ranch, CA (US); William A. Parkyn, Lomita, CA (US); Oliver Dross, Köln (DE)

(73) Assignee: Light Prescriptions Innovators, LLC, Altadena, CA (US)

( * ) Notice: Subject to any disclaimer, the term of this patent is extended or adjusted under 35 U.S.C. 154(b) by 12 days.

(21) Appl. No.: 12/456,392

(22) Filed: Jun. 15, 2009

(65) Prior Publication Data

US 2009/0323338 A1 Dec. 31, 2009

Related U.S. Application Data

(60) Provisional application No. 61/132,258, filed on Jun. 16, 2008, provisional application No. 61/212,694, filed on Apr. 15, 2009.

(51) Int. Cl.
*F21V 7/00* (2006.01)

(52) U.S. Cl. ..... 362/296.01; 362/297; 362/373; 362/346

(58) Field of Classification Search ..... 362/247, 362/345, 294, 373, 346, 350, 296.01, 297, 362/304

See application file for complete search history.

(56) References Cited

U.S. PATENT DOCUMENTS

| | | | | |
|---|---|---|---|---|
| 4,070,499 | A * | 1/1978 | Ramler et al. | 427/508 |
| 4,277,821 | A * | 7/1981 | Sassmannshausen | 362/346 |
| 4,996,635 | A * | 2/1991 | Olsson et al. | 362/477 |
| 5,219,445 | A | 6/1993 | Bartenbach | 362/341 |
| 6,364,506 | B1 | 4/2002 | Gallo | 362/245 |
| 6,598,996 | B1 | 7/2003 | Lodhie | 362/249 |
| 6,682,211 | B2 | 1/2004 | English et al. | 362/545 |
| 6,846,100 | B2 | 1/2005 | Imazeki et al. | 362/517 |
| 6,953,264 | B2 * | 10/2005 | Ter-Hovhannisian | 362/241 |
| 7,070,301 | B2 | 7/2006 | Magarill | 362/241 |
| 7,246,919 | B2 | 7/2007 | Porchia et al. | 362/276 |
| 7,249,877 | B2 | 7/2007 | Johnson et al. | 362/545 |
| 2004/0066142 | A1 * | 4/2004 | Stimac et al. | 315/50 |
| 2009/0016063 | A1 * | 1/2009 | Hu | 362/294 |
| 2009/0016072 | A1 * | 1/2009 | Lee et al. | 362/373 |

FOREIGN PATENT DOCUMENTS

| | | |
|---|---|---|
| EP | 1826474 | 8/2007 |
| JP | 2003-347595 | 12/2003 |
| JP | 2008507095 | 3/2008 |

* cited by examiner

*Primary Examiner* — Evan Dzierzynski
(74) *Attorney, Agent, or Firm* — Drinker Biddle & Reath LLP

(57) ABSTRACT

A cylindrical light source comprises multiple LEDs mounted on either the exterior or interior surface of the cylinder, with heat-sink fins respectively on its interior or exterior. The LEDs emit radially, but their emission is redirected along the cylinder axis by individual ellipsoidal reflectors.

20 Claims, 15 Drawing Sheets

1400

MULTI-REFLECTOR LED LIGHT SOURCE WITH CYLINDRICAL HEAT SINK

CROSS REFERENCE TO RELATED APPLICATION

This application claims benefit of U.S. Provisional Patent Applications No. 61/132,258, filed Jun. 16, 2008, and No. 61/212,694, filed Apr. 15, 2009, the disclosures of which are incorporated herein by reference in their entirety.

BACKGROUND OF THE INVENTION

In the ongoing endeavor to use multiple light emitting diodes (LEDs) in commercial lighting fixtures, there are two primary aspects, optical and thermal, that require careful consideration. Several US patents disclose reflective types of LED combiners. In U.S. Pat. Nos. 7,246,919 B2; 6,846,100 B2; 6,598,996 B1; and 6,364,506 an array of LEDs is mounted on a planar base, attached to an Edison screw connector. That approach, however, enlarges the emitting area and complicates thermal management. U.S. Pat. Nos. 7,249,877 and 6,682,211 B2 put an LED array at a location corresponding to the filament location of a corresponding incandescent bulb, but cooling is adequate only for low-power LEDs. What is needed is a fresh approach to multiple-LED employment, offering both superior cooling and compact beam-forming optics.

SUMMARY OF THE INVENTION

One aspect of the present invention is a complete light source, comprising multiple LEDs, their optics, drive electronics, and integral cooling via a cylindrical housing. The LEDs are either mounted on the interior surface of the cylinder, facing radially inwards or optionally are mounted on the exterior of the cylinder, facing radially outwards. The cylinder is preferably metallic, or a composite material with adequate thermal conductivity, with external or internal fins for convective cooling. Alternatively, the cooling can be accomplished using the novel approach described in U.S. Provisional Application 61/205,390 titled "Heat Sink with Helical Fins and Electrostatic Augmentation" by several of the same inventors. This application is incorporated herein by reference in its entirety.

Each LED, or group of LEDs, has its own reflector, which forms an output beam running along the cylinder axis. A plurality of such LEDs, preferably four or more, and their reflectors are nested outside and/or inside the cylinder, with the light coming out one end of the reflector. The electrical power cabling and mechanical supports may come out the other end of the reflector. The combined light output of the four or more reflectors forms a typical PAR-type flood pattern. The advantage of this approach is multi-fold. The optical efficiency of the system is very high as the only losses come from absorption losses of light striking the reflectors. As such the intercept efficiency is typically at 90% (amount of light from the LED that gets to the target, with optical efficiency=reflectivity*intercept efficiency). In addition, the design may be made extremely compact allowing the system to operate inside a conventional 6 inch (15 cm) diameter ceiling can of conventional downlights.

Furthermore, the architecture aids in the creation of thermal cooling via convection loops even inside an insulated can. Using state-of-the-art white LEDs, the system can safely handle 15 watts of electrical power input to the LEDs (of which about ¾ is converted into heat) even with the system installed in an insulated can, as long as the room temperature is 35° C. or less. For example, using five CREE Corporation (of North Carolina) model MC-E white LEDs, flux levels of well over 1400 lumens (cool white) can be projected onto the floor. Using warmer color LEDs from the same manufacturer and others, the system can output approximately one thousand lumens with a color temperature under the 3000° K of incandescent light bulbs. This can be achieved with a sizable temperature safety margin for the system components. Thus this new approach makes it possible to produce solid state replacement lamps for the most popular PAR 20 and PAR 30 lamps, and even some PAR 38 lamps.

Other aspects of the invention provide reflector and cylinder sub-assemblies around which the complete light source may be built.

BRIEF DESCRIPTION OF THE DRAWINGS

The above and other aspects, features and advantages of the present invention will be apparent from the following more particular description thereof, presented in conjunction with the following drawings wherein.

DETAILED DESCRIPTION OF THE PREFERRED EMBODIMENTS

A better understanding of the features and advantages of the present invention will be obtained by reference to the following detailed description of the invention and accompanying drawings, which set forth illustrative embodiments in which various principles of the invention are utilized.

Figure 1:
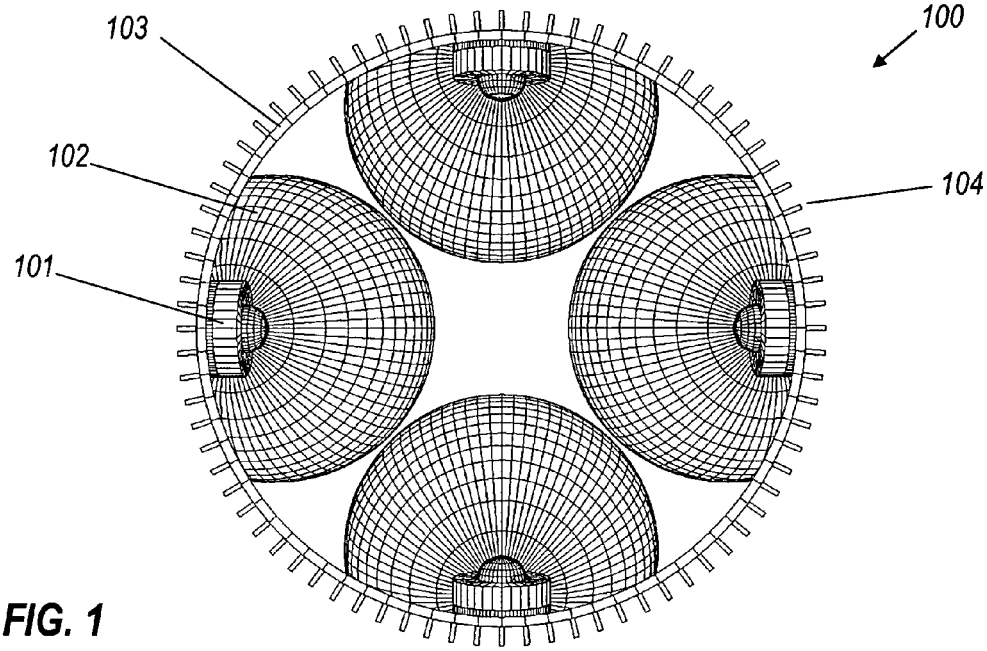
FIG. 1 is a bottom plan view of a light source with four LEDs mounted internally on a cylindrical heat sink.

Referring to the drawings, and initially to FIGS. 1 through 5, FIG. 1 shows a plan view of an embodiment of a light source, indicated generally by the reference number 100, comprising LED packages 101, ellipsoidal reflectors 102, mounting cylinder 103, and convective fins 104. The ellipsoidal reflectors 102 are mounted on the inside of the cylinder 103, with each LED package 101 mounted centrally within a respective reflector 102. The fins 104 extend axially along, and project radially from, the outside of the cylinder 103. When the light source 100 is mounted in a ceiling can, the view shown in FIG. 1 is the view of the light source 100 as seen looking up from the floor.

The downward intensity of the direct light from the LEDs is very low, one of the advantages of this design. Also, the area of the images of the LED sources seen from below is very small. Each LED appears to the observer as two small point like sources. One apparent source is the actual LED, which is the source of the portion of the light that exits the device without reflection. The other apparent source is the virtual source of the portion of the light that is reflected from beam forming optics before exiting. (In a more general case, the virtual source could appear as more than one apparent point-like source.) Thus, the bulb (light source 100 as a whole) in a direct view appears as a compact "stars" field. This is advantageous as it reduces the glare compared with light sources that are extended in area, which is the case for most current solid state light products. The reason for this advantage is that the human eye has adapted over thousands of years to be comfortable seeing many small bright objects on a dark background (the stars) but has not adapted as well for large area sources (a more recent phenomenon). An illuminating apparatus intended to simulate the appearance of a starry sky is described in U.S. Pat. No. 5,219,445 to Bartenbach.

Figure 2:
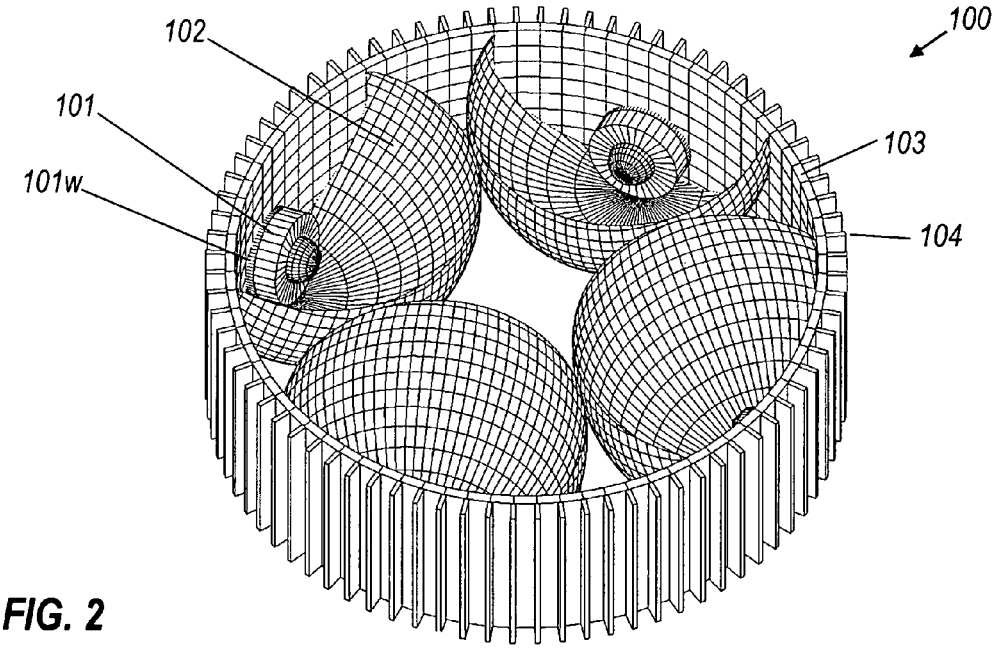
FIG. 2 is a perspective view of the light source shown in FIG. 1.

FIG. 2 shows a perspective view of the light source 100 of FIG. 1, also showing a better view of a mounting wedge 101*w*. The mounting wedges 101*w* are interposed between LED packages 101 and cylinder 103 so that package 101 faces slightly downwards, at a 10° angle from the wall of cylinder 103. Wedge 101*w* is preferably composed of a highly thermally conductive material such as copper.

Figure 3:
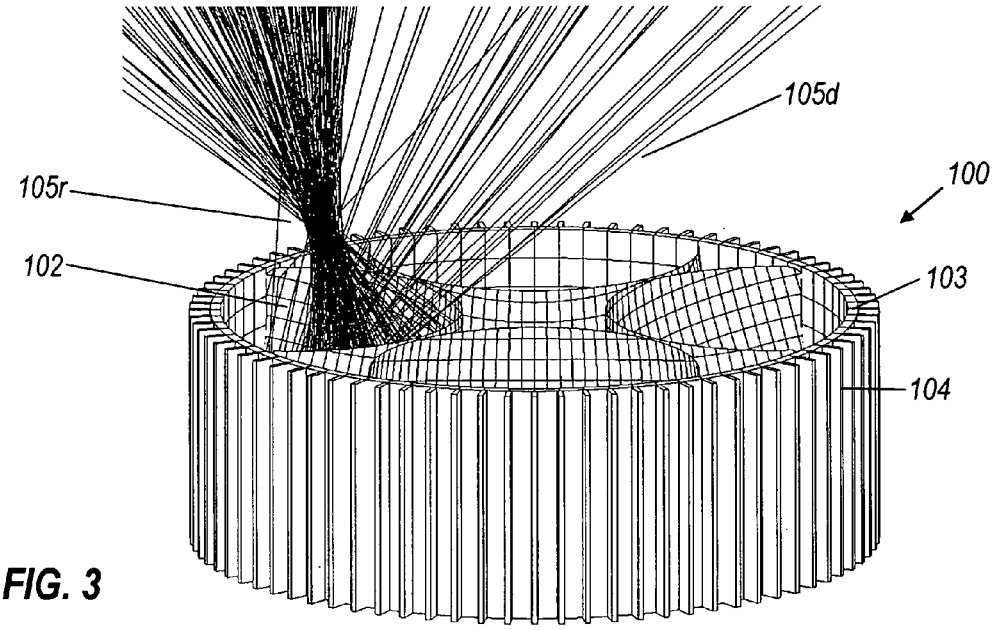
FIG. 3 is a perspective view of the light source shown in FIG. 1, showing light output, both reflected and unreflected, from one LED.

FIG. 3 shows a different perspective view of the same light source 100, also showing rays 105*r* that, after being emitted by one of the LEDs 101, are reflected by the ellipsoidal mirror 102 into a caustic at the second focus of ellipsoid 102. As may be seen from the pattern of rays 105*r* in FIG. 3, the LED 101 is approximately at the first focus of the ellipsoid 102, and the second focus is approximately vertically below the first focus, and below the bottom rim of reflector 102 and mounting cylinder 103. FIG. 3 also shows direct rays 105*d*, which are rays emitted straight out from the same one LED 101 without meeting mirror 102.

Figure 4:
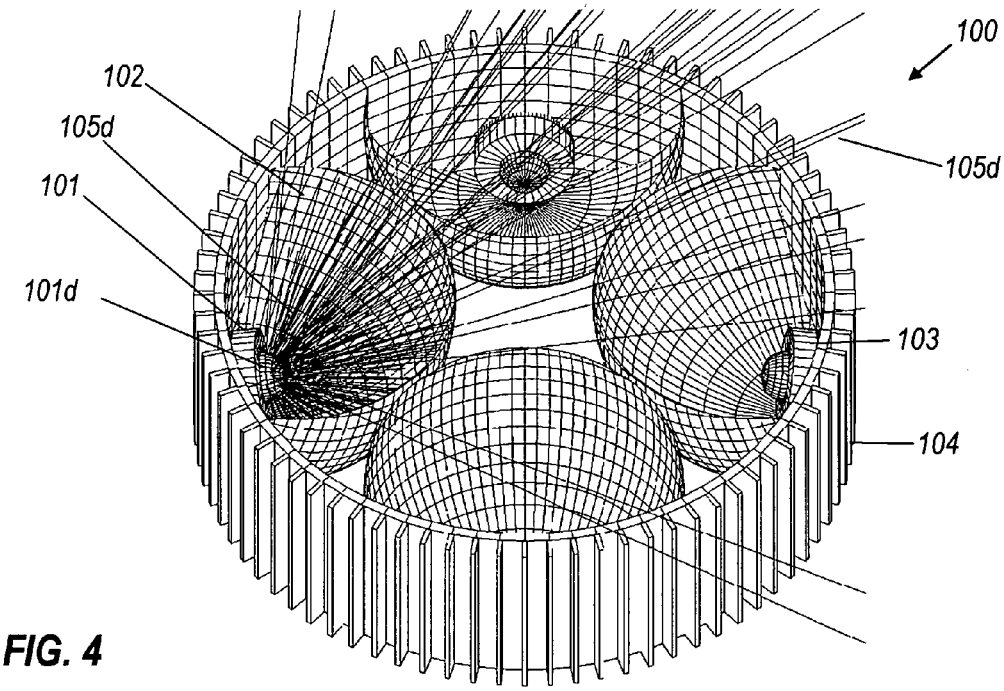
FIG. 4 is a perspective view of the light source shown in FIG. 1, showing unreflected light output from one LED.

FIG. 4 shows a different perspective view of the same light source 100, showing only direct rays 105*d*.

Figure 5:
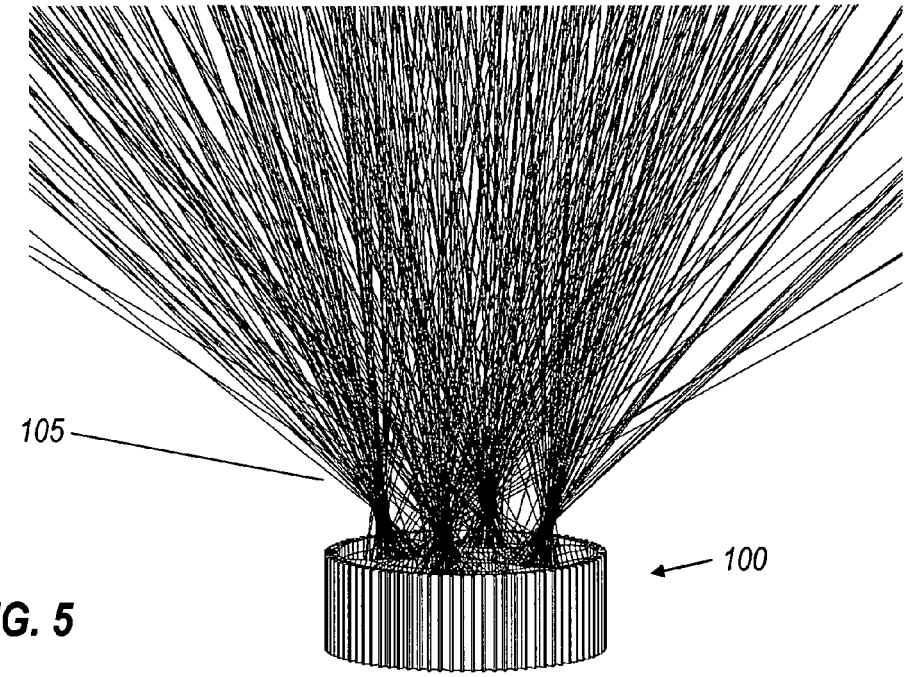
FIG. 5 is a perspective view of the light source shown in FIG. 1, showing the entire output of the light source.

FIG. 5 shows a further perspective view of the same light source 100, showing light emission 105 of all four LEDs 101. (The LEDs themselves are not visible in FIG. 5 because of the angle of view).

Figure 6:
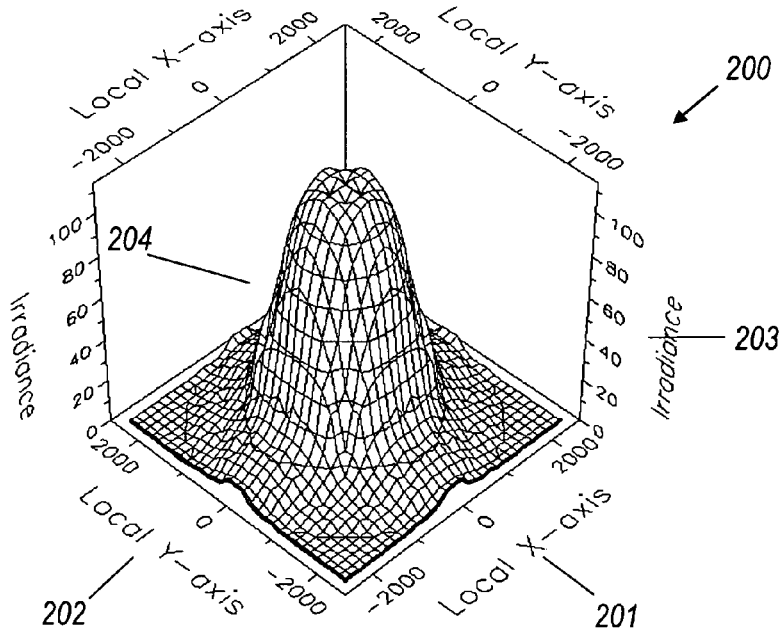
FIG. 6 shows the illuminance pattern of the light source of FIG. 1.

FIG. 6 shows an isometric view of a normalized illuminance graph 200, having a horizontal X axis 201 and horizontal Y axis 202, with scales in millimeters, and vertical intensity axis 203, running from 0 to 1. Graphical surface 204 represents the spatial distribution of light 3 meters from the light source. The Z axis in FIG. 6 is assumed to be the axis of symmetry of light source 100 (vertically downwards for a ceiling can light) and the mounting cylinder 103 with its cooling fins 104 is assumed to fit within a 6" (15 cm) diameter ceiling can.

Figure 7:
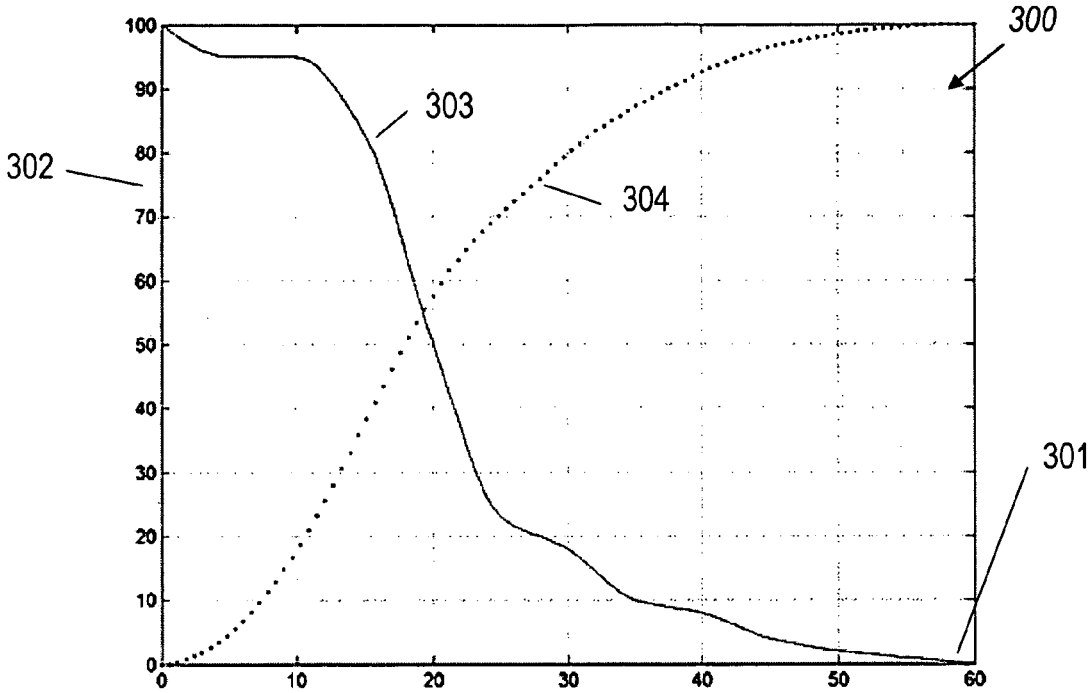
FIG. 7 shows the far-field intensity pattern of the light source of FIG. 1.

FIG. 7 shows a normalized intensity graph 300, comprising horizontal axis 301 representing emission angle in degrees of arc from the axis of cylinder 103 of FIG. 1 and vertical axis 302 representing azimuthally integrated relative output in percent. Curved line 303 shows the angular intensity of light source 100 of FIG. 1, relative to 100% on axis, falling to zero at about 60° off axis. Dotted curve 304 is a cumulative energy curve that shows as a function of angle off axis the energy of the part of the intensity distribution of light source 100 within a cone having the specified half-angle centered on the axis. Although the half-power point is at 20° off-axis, half the total energy is within 18° off-axis, a characteristic of a 'peaky' distribution, which is typical of commercial incandescent PAR lamps.

Figure 8:
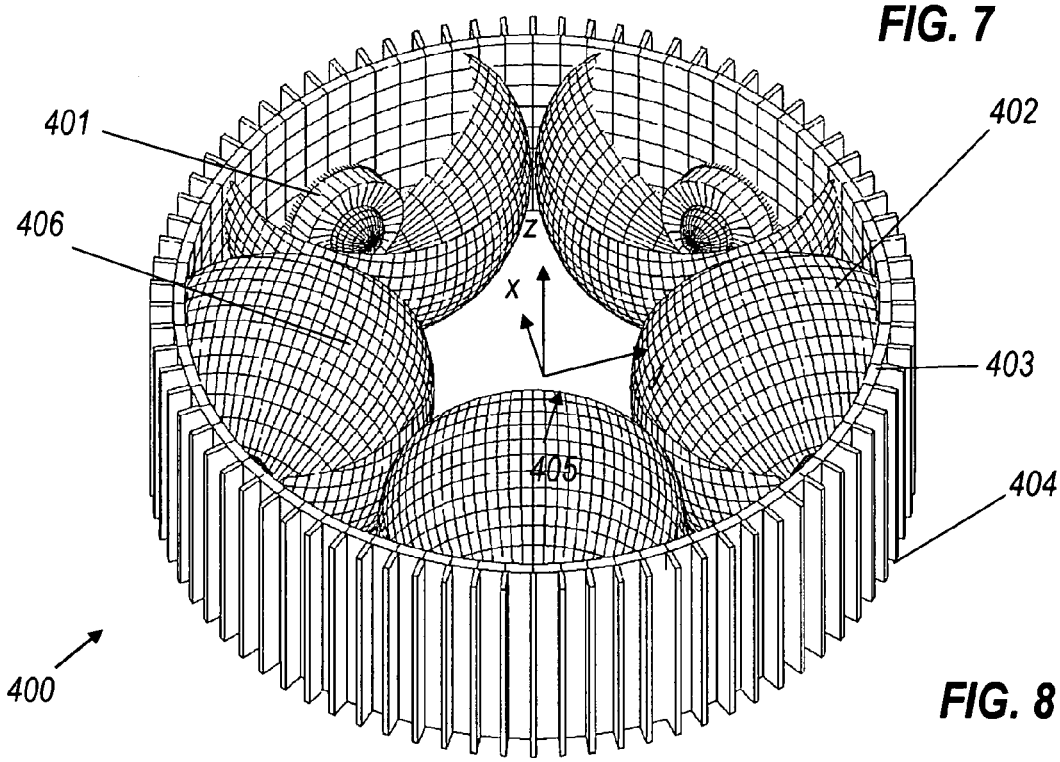
FIG. 8 shows a perspective view of a 5-LED light source.

In case a light source with five LEDs is desired, FIG. 8 shows a perspective view of a further embodiment of light source 400, comprising five LED packages 401, toroidal reflectors 402, mounting cylinder 403, and convective fins 404 (not shown to scale). Coordinate triad 405 has its Z axis along the center axis of mounting cylinder 403, and is aligned with the particular reflector 406 which is numbered, that is to say, with the negative direction of the Y axis radially outward through the center of the particular reflector 406. The toroidal reflector differs subtly from an ellipsoidal shape. In a local coordinates system with the origin at the reflector apex, the toroid is described by the equation:

$$\mathrm{Sag}=(v_x x^2+v_y y^2)/(1+\mathrm{sqrt}\{1-(1+k_x)v_x^2x^2-(1+k_y)v_y^2y^2\}),$$

where $v_x$, $v_y$ are sagittal and meridional curvatures and $k_x$, $k_y$ are conic coefficients. Each reflector is oriented with the y axis of the sag coordinate system radial to the mounting cylinder 403, in the 0YZ plane of triad 405. The sag describes the axial position z of the point with coordinates (x,y). The following table provide $k_x$, $k_y$, $v_x$, and $v_y$ coefficients for two preferred embodiments for the 5-LED light source of FIG. 8. Embodiment #1 uses a CREE MC-E LED and Embodiment #2 uses a Nichia NCSL 136 LED.

| | Parameters | | | | |
|---|---|---|---|---|---|
| | $k_x$ | $k_y$ | $v_x$ | $v_y$ | A |
| Embodiment #1 | −0.56 | −0.49 | 1/9.10 | 1/9.42 | 16° |
| Embodiment #2 | −0.57 | −0.49 | 1/7.65 | 1/7.85 | 15.8° |

Starting from the coordinate system 405 shown in FIG. 8, the sag-axis coordinates of the reflector as described above are shifted in the −Y direction of coordinate system 405 by 28.3 mm for embodiment #1 and by 28.5 mm for embodiment #2 and then rotated through the angle A counter-clockwise relative to the positive X direction (that is to say, angling the sag-axis of the toroid towards the center of the illuminated area beyond the exit end of the light source 400), around the point with coordinates shown in the table of rotation points below.

For the two embodiments the coordinates of the points of rotation on angle A are

| | Y/mm | Z/mm |
|---|---|---|
| Embodiment #1 | −28.3 | 7.2 |
| Embodiment #2 | −28.5 | 6 |

in the coordinate system 405 with its origin at the center of cylinder 403.

The source center positions are

| | Y/mm | Z/mm |
|---|---|---|
| Embodiment #1 | −28.4 | 7.434 |
| Embodiment #2 | −29.7 | 6.195 |

The foci of the toroid are the following positions

| | Meridional | | Sagittal | |
|---|---|---|---|---|
| | Y/mm | Z/mm | Y/mm | Z/mm |
| Embodiment #1 | −28.542 | 6.356 | −28.67 | 5.88 |
| Embodiment #2 | −28.701 | 5.287 | −28.807 | 4.912 |

The tolerances for foci positions with respect to the source positions are 0.1 mm in x,y,z directions.

The inside diameter of the cylinder 403 is designed for the mounting of LEDs and equal to 56.8 mm for Embodiment #1 and 59.4 mm for Embodiment #2. Thus, the LED sources are approximately flush with the inner face of the mounting cylinder 403. Attaching the LED sources to the face of the mounting cylinder 403 is in practice sufficiently close to flush. The minimum length of the cylinder 403 and reflectors 402 for Embodiment #1 is 27 mm and for Embodiment #2 is 22 mm. The length can be extended away from the exit end to provide space and support for LED drivers and other electronics. Both Embodiment #1 and Embodiment #2 produce a ±30° output beam.

The toroidal reflectors 402 are double ellipsoids having an aspheric modification that induces tailored aberrations. The aberrations' function is to remove source irregularities from the beam pattern output. That assists in producing a uniform circular output (as the combined output from all the light sources) for the central part of the pattern.

Figure 9:
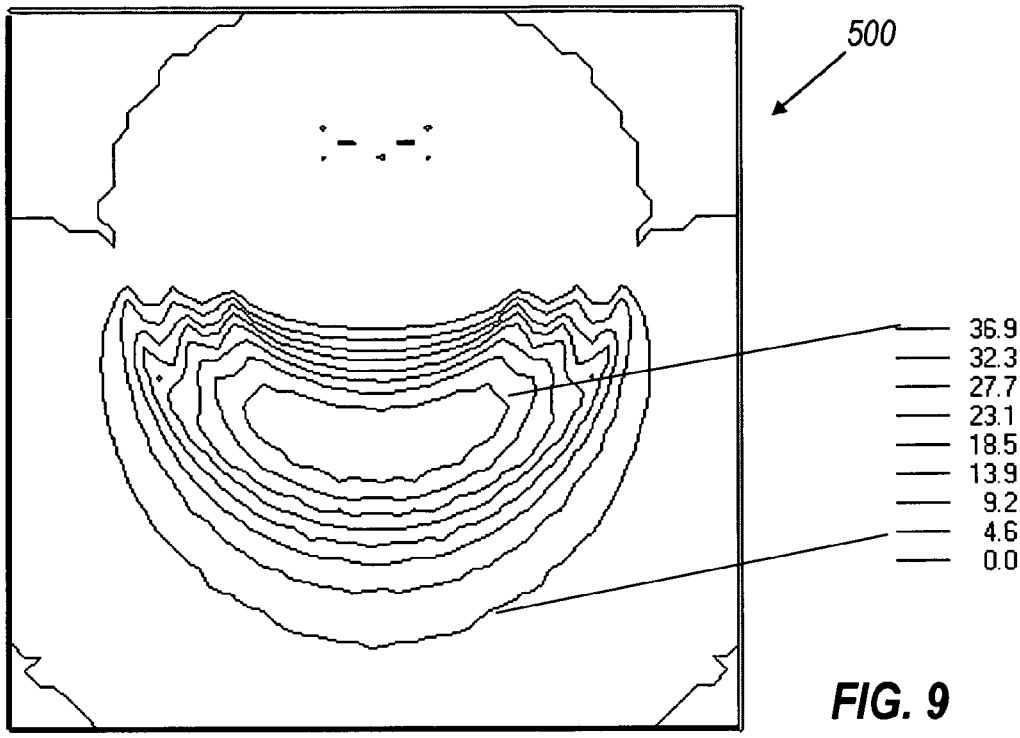
FIG. 9 is a contour graph of illuminance when one LED of the 5-LED light source of FIG. 8 is emitting.
Figure 10:
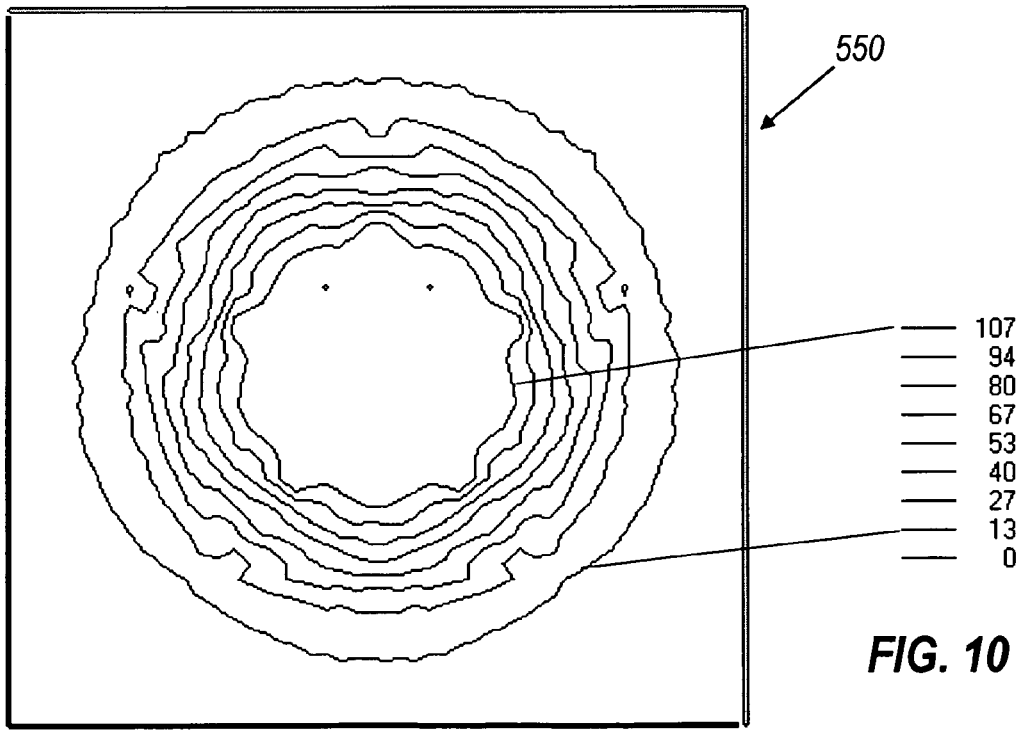
FIG. 10 is a contour graph of illuminance when all LEDs of the 5-LED light source of FIG. 8 are emitting.
Figure 11:
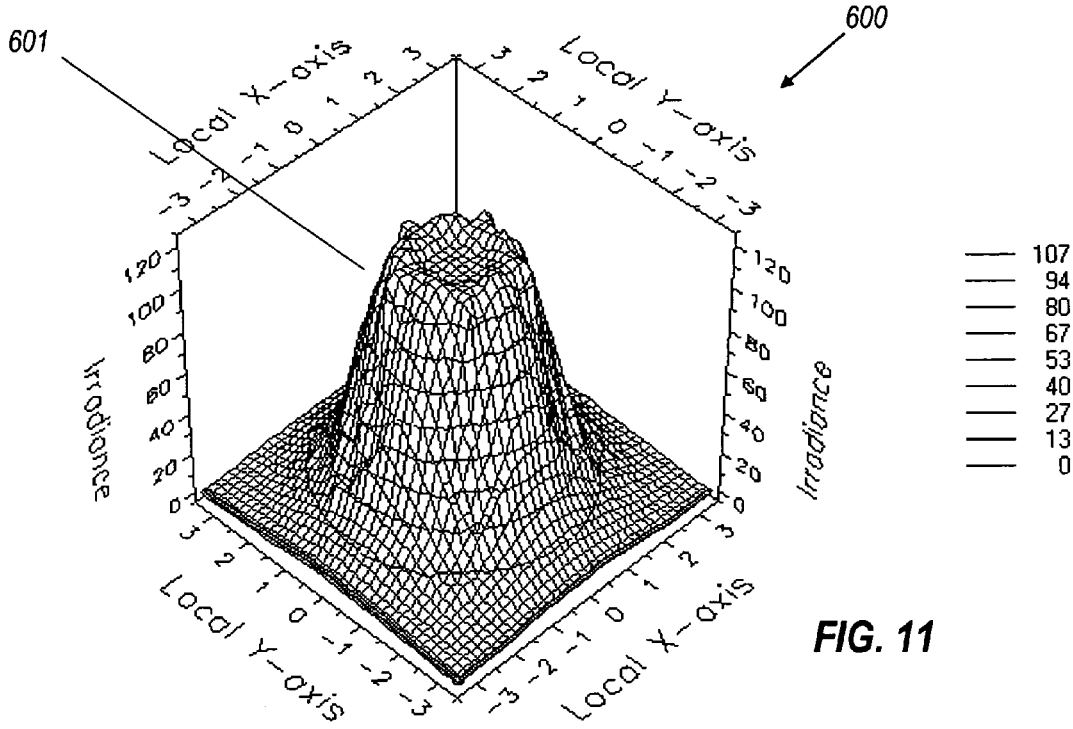
FIG. 11 shows an isometric view of the illuminance when all LEDs of the 5-LED light source of FIG. 8 are emitting.

For the lux values projected by a single LED of FIG. 8, FIG. 9 shows contour graph 500 with lux values listed and lined up with their corresponding contours. This is based on the output of Embodiment #1. FIG. 10 shows contour graph 550 for all LEDs of FIG. 8, also with lux values listed, of course much higher than in FIG. 9. FIG. 11 is an isometric view of illuminance at the plane 3 meters from the bulb, in which graph 600 has a surface 601 representing the lux values at each X, Y point under the lamp. The X and Y coordinates are in meters. The pattern for the case when all five LEDs are turned on is circular to a good approximation. The output pattern from a single LED is asymmetric. This is a novel approach as the prior art requires that each of the five beam outputs have circular symmetry. One benefit of this new approach is that the dimensions of the lamp can be reduced (versus the prior art), especially the diameter. This allows the lamp to be small enough to fit into a standard can while still achieving high flux.

For most purposes, the output pattern when all LEDs are turned on is sufficiently close to circular that any trace of polygonal pattern can be ignored. However, in special situations the number and orientation of the LEDs (four as shown in FIG. 1, five as shown in FIG. 8, or another number) may be chosen to provide a desired illumination pattern and/or a desired appearance when the light source 100, 400, etc. is viewed directly. In such cases, it may be appropriate to configure the light source with a more pronounced polygonal light distribution that would usually be regarded as non-optimal.

Figure 12:
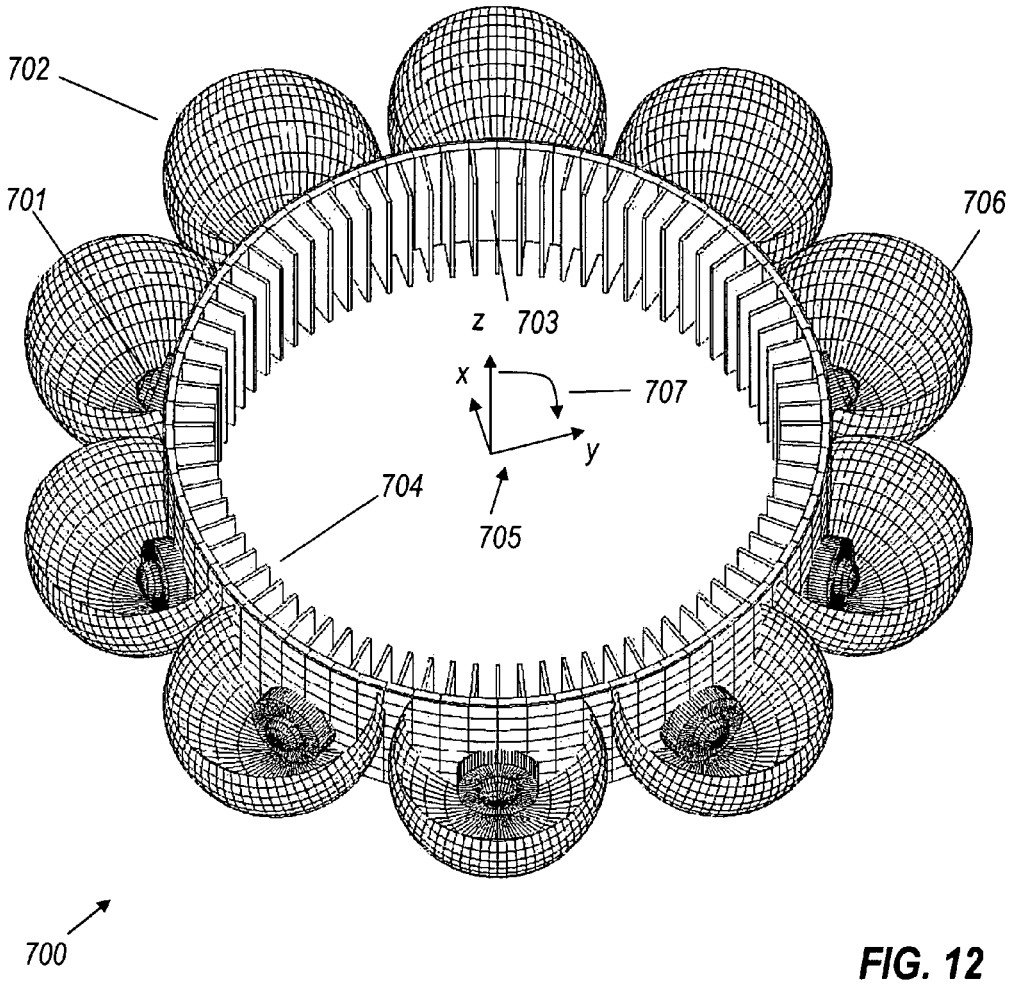
FIG. 12 shows a perspective view of a light source with 10 LEDs and reflectors, mounted externally on a cylindrical heat sink.

FIG. 12 shows a perspective view of a further embodiment of a light source 700, comprising ten LED packages 701, their ten reflectors 702, mounting cylinder 703, and convective fins 704. Interior convective fins 704 are diagrammatic rather than representative of actual designs. Typically, the surface area of the fins will be 10 square inches (65 $cm^2$) or more for each watt of heat from the LEDs. Also, in order for the convective loop to function properly in an insulated can, the distance between the fins should be approximately 10 mm. As described, the light source 700 shown in FIG. 12 has a mounting cylinder 703 approximately 33 mm in radius, implying a circumference of 20 cm, so about 20 fins instead of the 80 fins shown. If the total heat dissipation is about 10 Watts thermal, which is a reasonable target for an LED downlight, each fin might then be around 1 cm (0.4 inches) in radial width and 16 cm (6.5 inches) in axial length, which is feasible within the dimensions of a conventional ceiling can. However, smaller fins may be preferred, for aesthetic reasons, where a lower thermal load permits. A more efficient cooling system uses the helical vanes of U.S. Provisional Application 61/205,390, or better still, the helical vanes with electro-static augmentation described in that application, which is incorporated herein by reference. Using the helical fins of that application, the length of the thermal management device can be reduced to 5 cm (2 inches), or only about one third of the length of the vertical system mentioned above, without reduction in cooling capacity.

With ten of the current Cree XP-E LED's this embodiment can provide 800 to 1000 lm light output (warm white). The following table provides $k_x$, $k_y$, $v_x$, and $v_y$ coefficients for a preferred embodiment for the 10-LED light source of FIG. 12.

| Parameters | | | | |
|---|---|---|---|---|
| $k_x$ | $k_y$ | $v_x$ | $v_y$ | A |
| −0.57 | −0.54 | 1/7.55 | 1/6.9 | 16° |

Starting from the central axis of mounting cylinder 703 shown in FIG. 12, the sag-axis coordinates of the reflector as described above are shifted radially outward by 35.5 mm and then rotated through the angle A counter-clockwise relative to the positive X direction. The angle of rotation for reflector 706 in FIG. 12 is in the direction of arrow 707 for coordinate system 705 for FIG. 12.

The coordinates for the center of rotation for angle A are:

| Y/mm | Z/mm |
|---|---|
| 35.5 | 6 |

in the coordinate system 705 with its origin at the center of cylinder 703.

The source center position is

| Source center position | |
|---|---|
| Y/mm | Z/mm |
| 33.8 | 5.425 |

and the axis of the LED is orthogonal to the axis of the cylinder 703.

The positions of the foci of the reflector nearest the source are:

| Meridional | | Sagittal | |
|---|---|---|---|
| Y/mm | Z/mm | Y/mm | Z/mm |
| 35.08 | 4.54 | 35.103 | 4.846 |

Figure 16:
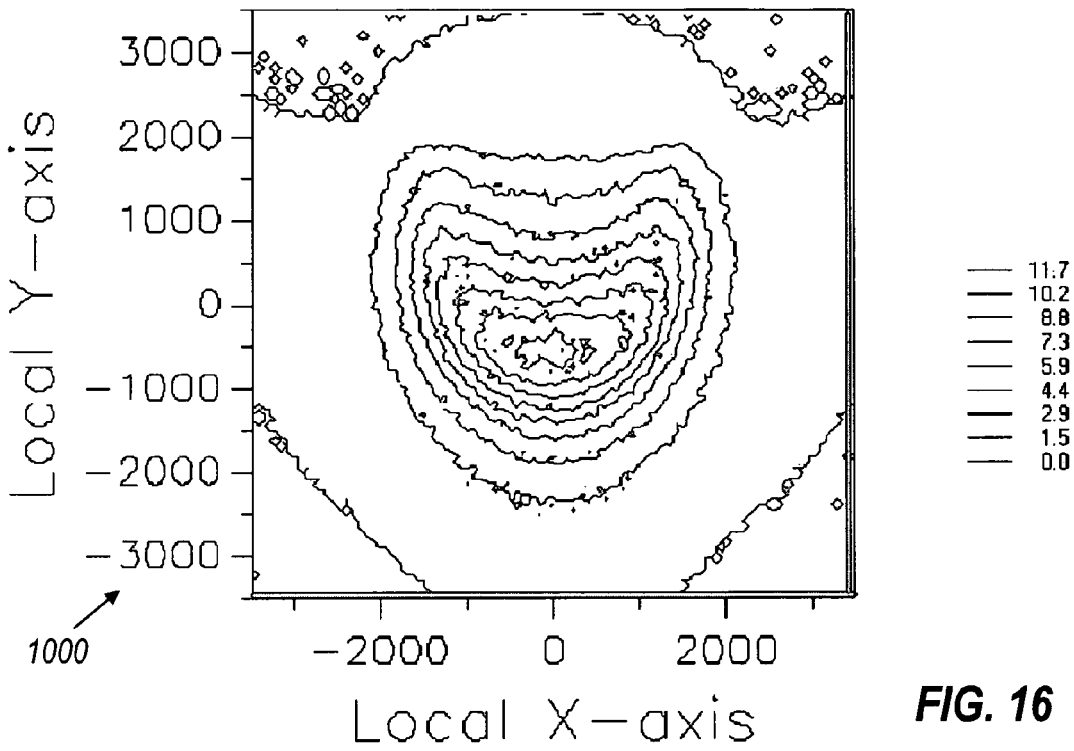
FIG. 16 is an illuminance contour graph for the 10-LED system of FIG. 12 with one LED emitting.
Figure 17:
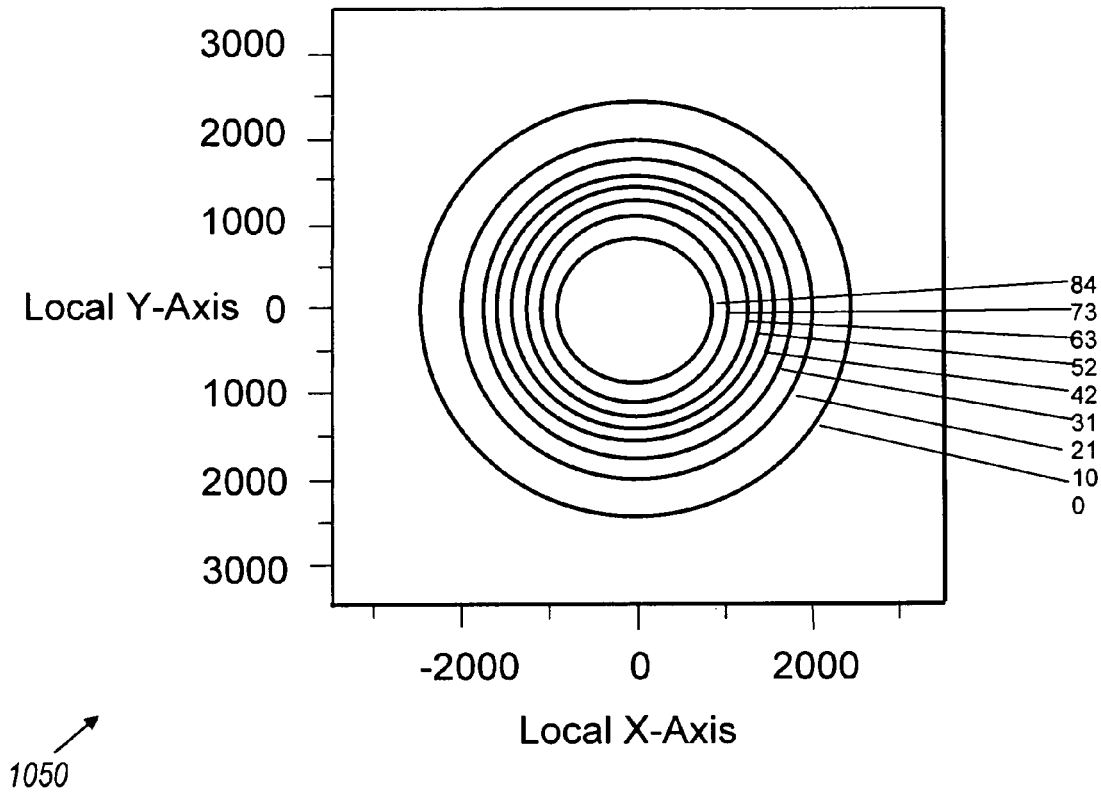
FIG. 17 is an illuminance contour graph for the system of FIG. 12 with all 10 LEDs emitting.
Figure 18:
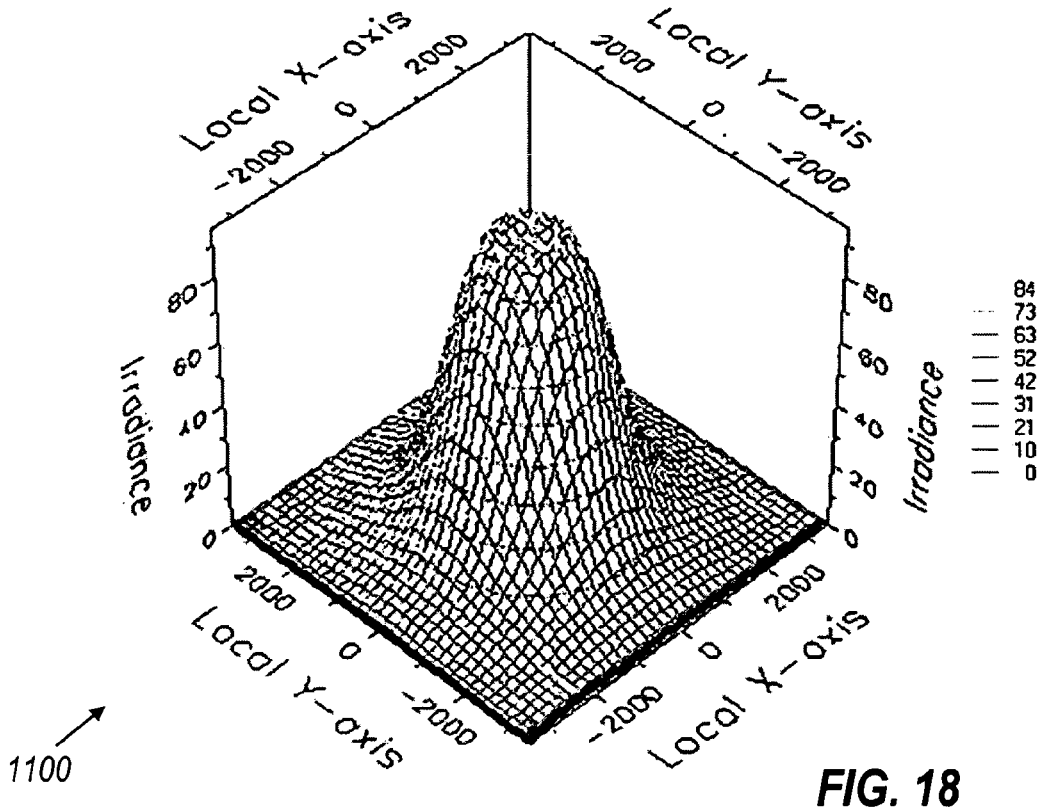
FIG. 18 shows an isometric view of the illuminance when all LEDs of the 10-LED light source of FIG. 12 are emitting.

FIG. 16 shows contour graph 1000 of the illuminance values in lux projected by a single XPE LED for the embodiment of FIG. 12. FIG. 17 shows illuminance contour graph 1050 with all ten XPE LEDs of FIG. 12 emitting. FIG. 18 is an isometric view of illuminance for the ten-LED lamp on a plane 3 meters from the lamp. The X,Y coordinates at the illuminated plane are shown in mm. The pattern for the case when all ten LEDs are emitting is circular to a good approximation. The output pattern from the single LED is asymmetric. This is a novel approach as the prior art requires that each of the ten beam outputs have circular symmetry. In FIG. 16 the maximum intensity from the single LED spot is shifted away from the central axis of the lamp. Superposition of all ten LEDs creates the circular spot with the extended flat plateau shown in FIGS. 17 and 18.

Figure 19:
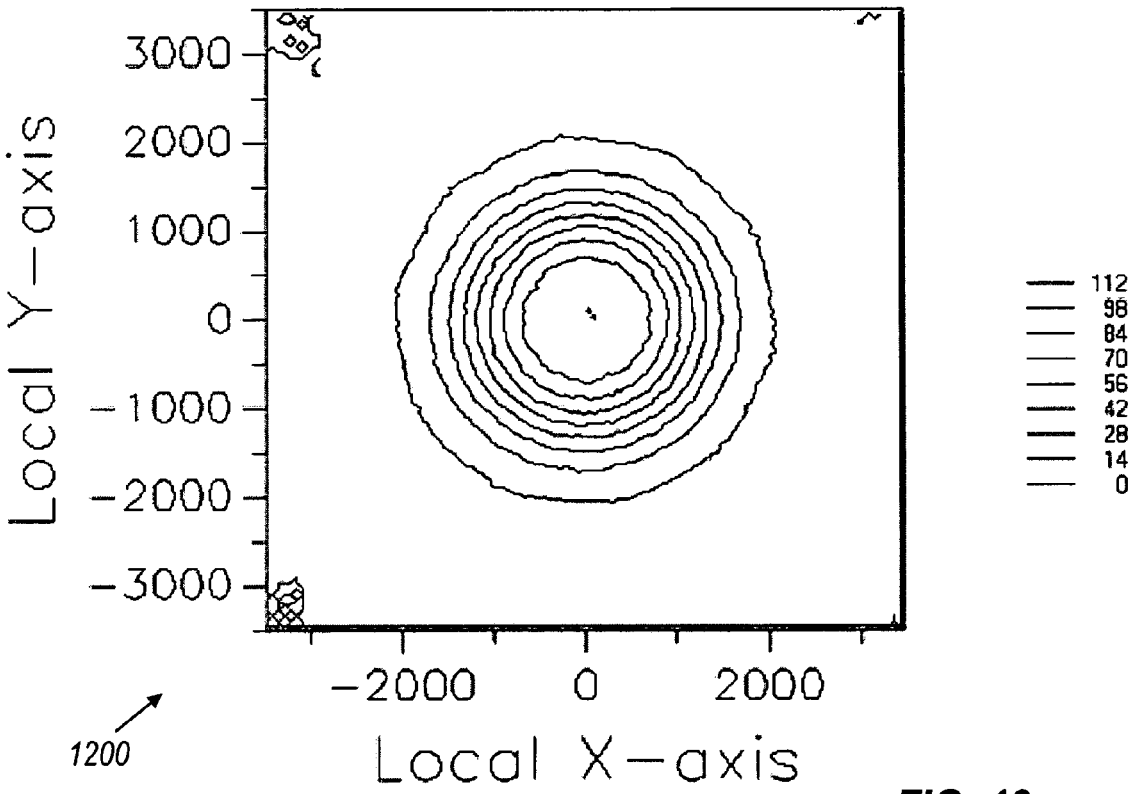
FIG. 19 shows an isometric view from the same 10-LED light source when the LEDs are moved away from their nominal position.

FIG. 19 shows an illuminance contour graph 1200 for a spot located at 3 meters from the lamp of FIG. 12 with 10 XPE LEDs all illuminated, with the LEDs shifted out of the nominal position 0.3 mm in the axial lamp direction (Z direction in FIG. 12) and 0.3 mm in lateral −X,Y direction. Contours are at steps of 14 lux from 0 lux to 112 lux. The size of the spot is the same as in FIG. 17. The central part of the pattern with a flat plateau is transformed to a Gaussian type distribution. This elevates the illumination level at the center of the spot to 112 lux. Such performance tolerances are acceptable for typical illumination applications. Therefore, the lamp can be said to have a ±0.3 mm tolerance for positioning of the LEDs, an acceptable dimensional tolerance for volume manufacturing.

Figure 13:
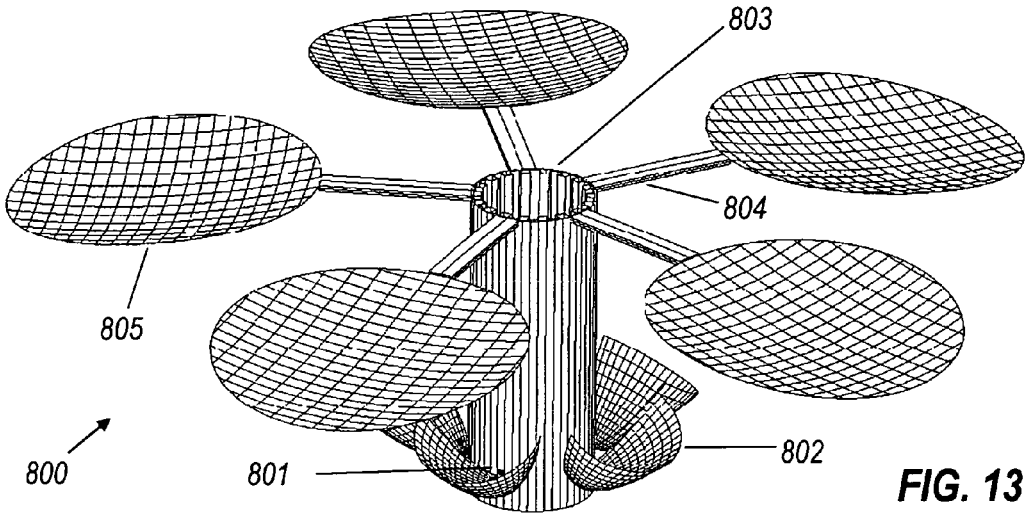
FIG. 13 shows a perspective view of a light source with five LEDs, along with primary and secondary reflectors.

FIG. 13 shows a further embodiment of a luminaire 800, comprising five lamps, with LEDs 801, each located off the focus of a respective cutaway paraboloidal primary reflector 802. The LEDs and reflectors are mounted on chimney 803, having interior fins 803*f*. The paraboloidal primary reflectors 802 face upwards and outwards. Struts 804 are connected to chimney 803 to support toroidal secondary reflectors 805, above the primary reflectors 802, which serve to spread out the light onto the floor below. The radial curvature of reflector 805 sends some of the light back under the associated primary reflector 801 so it can reach the part of the floor directly below the luminaire. The azimuthal curvature spreads the light out so the five patterns suitably overlap. FIG. 13 is a close-up perspective view of one of the LEDs 801 and its associated reflectors 802 and 803 of luminaire 800, showing light rays 801R.

Figure 15:
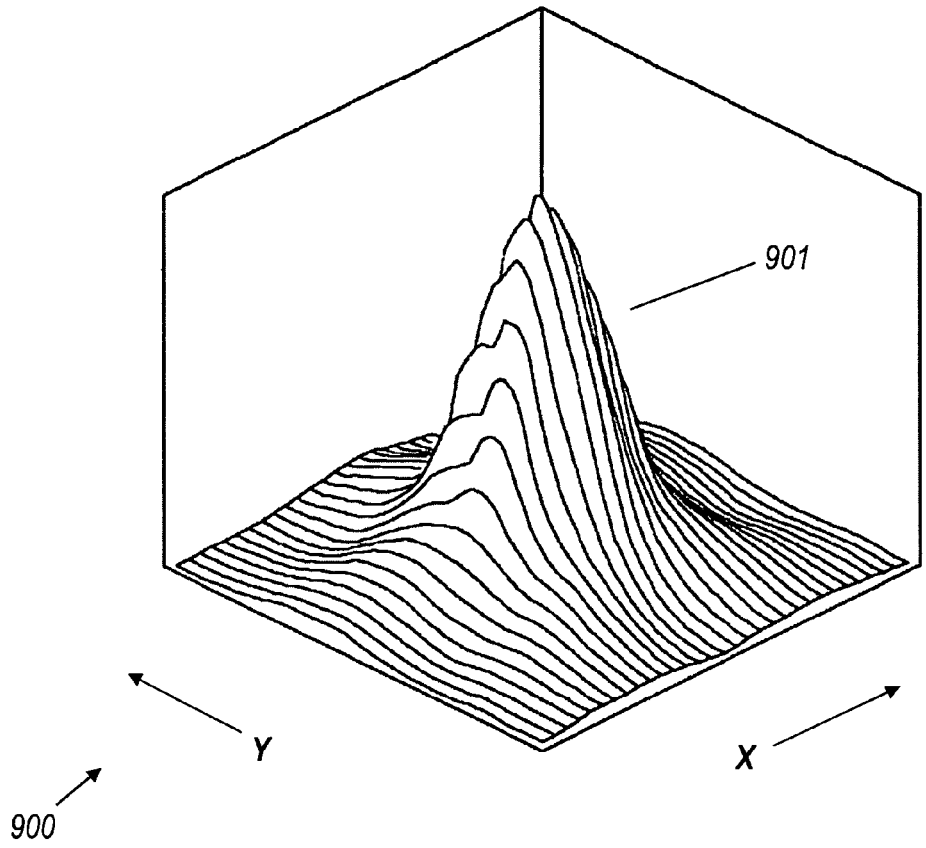
FIG. 15 is an isometric view of the illuminance distribution produced by the light source of FIG. 12.

FIG. 15 shows an isometric view of an illuminance graph 900 with surface 901 representing strength of illumination over the x and y axes on the floor under light source 800 of FIG. 13. A smooth, nearly circular pattern results from the superposition of the five patterns of the individual secondary reflectors. The two curvatures of toroidal secondary reflector 805 of FIG. 12 can be adjusted for different illumination patterns. In fact, the reflector 805 could have two surfaces of different shapes back to back, for example, two toroidal surfaces that differ in one or both of their primary curvatures, for different patterns. The two-surface reflector 805 would then be mounted so it can be rotated (not shown) around strut 804 so either of two toroidal surfaces could be selected.

Although the embodiments described herein use reflectors that are smooth and specular, the invention also includes embodiments where the reflectors make use of spreading surface features such as faceting, peening or mild diffusers (including kineform or holographic structures). Using spreading features on the reflectors homogenizes the beam more than specular reflectors but has the effect of spreading the beam output angle and tends to eliminate the sharp cut-off at the periphery of the beam. This may be desirable in some lighting applications. The effect of spreading features (faceting, peening, etc.) on beam output is described in the book "The Optical Design of Reflectors" by William B. Elmer, on pages 27 thru 29, which is incorporated herein by reference. In particular, equations 1, 2 and 3 in Elmer provide a way of quantitatively predicting the effect of spreading features based on the average diameter of the peened spots, their radius and the radius of curvature of the reflector. Elmer also provides a simplified equation for the special case of flat facets. Of course the range of possible spreading surfaces is not limited to those described by Elmer. It should be evident to those skilled in the art how such spreading features can be applied to the designs of the present application to achieve a required or desired beam output.

In some cases it is desirable to have a hybrid reflector where a portion of the reflector is specular and another portion uses spreading features. That can be useful for eliminating artifacts in a beam pattern where the artifacts stem from a particular segment of the reflector. In that situation the reflector can be shaped so that only the segment causing the problem has spreading features on it.

For the embodiments described herein for the 5-LED and 10-LED systems, the reflectors are designed to wrap around the source and are considered re-entrant surfaces from the standpoint of molding technology. The molding of these parts is still possible for those skilled in the art of designing and manufacturing molds. Indeed it is possible even to mold multiple reflectors (10 in the case of FIG. 12) at once. Alternatively, the array of reflectors (five or ten respectively for the embodiments of FIG. 8 and FIG. 12) can be molded in two halves with a draft angle at or near zero degrees for each half. Finally, it is also possible to simply remove the small portion of the reflector that is re-entrant. Removal of this small section of the reflectors has little effect on the illumination pattern from the light source, as was proven by extensive ray tracing modeling carried out by the inventors.

Figure 20:
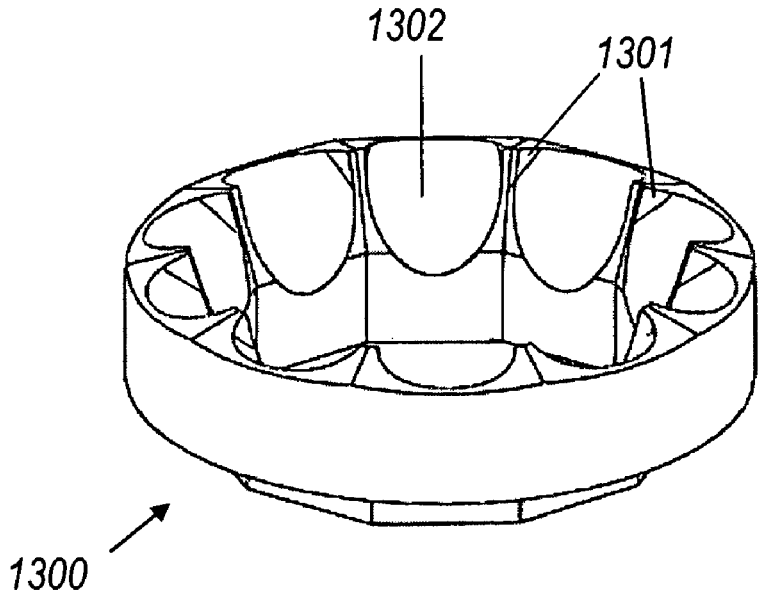
FIG. 20 shows a modified form of the design of FIG. 12 with both smooth and faceted sections for simplified molding.

FIG. 20 shows one half of a mold 1300 for a hybrid version of the embodiment of FIG. 12 combining triangular planar facets 1301 and smooth surfaces 1302 to make the 10-reflector part more easily moldable. No part of the 10-reflector array of FIG. 20 is re-entrant, and therefore a single 10-reflector part comprising the mounting cylinder 703, cooling fins 704, and reflectors 706 can be molded in one piece using simplified molding techniques. The performance of the hybrid-reflector system is equal to the preferred embodiment previously described herein.

Figure 21:
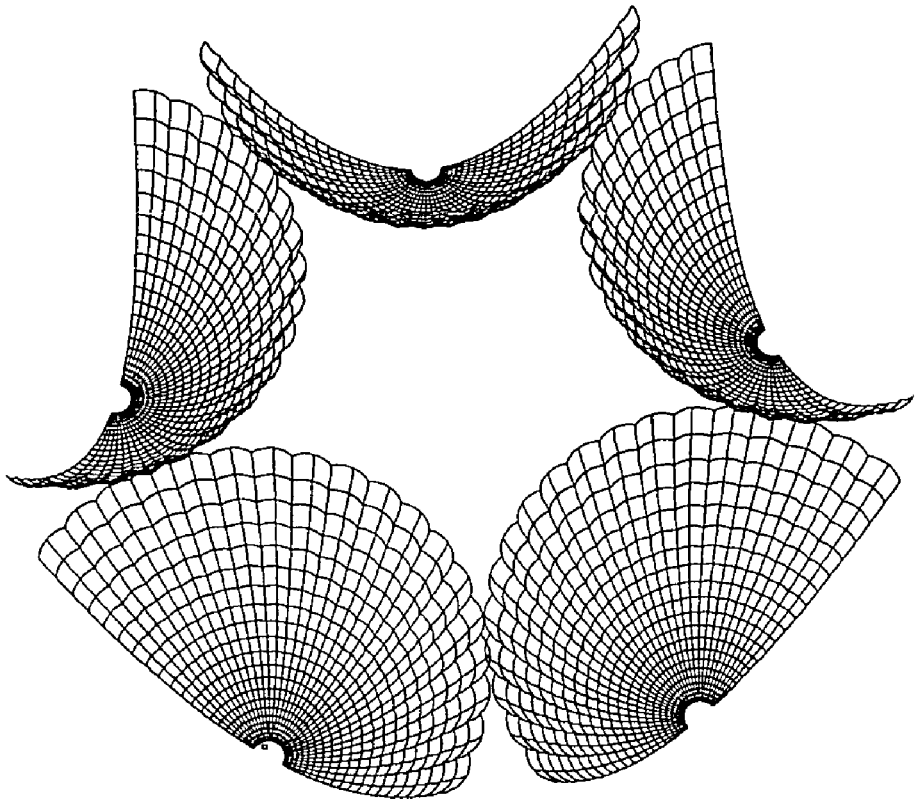
FIG. 21 shows a peened 5-LED reflector system with the reflectors facing inwards.

FIG. 21 shows a peened embodiment 1400 with 5 reflectors, wherein the reflectors are facing inwards, as in FIG. 8. The mounting cylinder is omitted from FIG. 21 to allow a clearer view of the reflectors. The peening features are sections of a sphere such that each feature produces a very similar circular pattern in the far field, thereby creating the desired beam pattern by multiple overlapping of beams with the same angle and shape (as opposed to the other approach described in this application). The overall shape of the reflectors in FIG. 21 is parabolic or it can also be compound parabolic. The peening features then convert the collimated beam from the original parabolic reflector into a uniform circular beam pattern with a desired divergence, controlled by the curvature of the individual peening features, that is wider than the pattern of the parent collimated beam. This is an alternative embodiment of the invention. This approach can also be used with other embodiments, including embodiments in which the reflectors facing outward as opposed to inward.

The preceding description of the presently contemplated best mode of practicing the invention is not to be taken in a limiting sense, but is made merely for the purpose of describing the general principles of the invention. The full scope of the invention should be determined with reference to the Claims.

Although various embodiments have been described, the skilled reader will understand how features of the different embodiments may be combined.

Various changes may be made in the described light sources without departing from the scope and spirit of the invention as claimed. For example, although the actual emitters of light are described as light emitting diodes (LEDs), other emitters, including emitters hereafter to be developed, may be used instead. Further, each LED package 101, 401, 701, 801 or other light emitter may comprise a plurality of LEDs mounted close together within a common modified or unmodified ellipsoidal reflector. The LEDs within each package may then be the same or different, and may be switched on or off together or separately.

The light sources shown in the drawings have been described as being used in ceiling can lights, but for convenience of illustration have in many cases been drawn with the exit end (which would be downwards in a ceiling fixture) facing upwards in the drawing. Terms of orientation such as "bottom" are used with reference either to the normal orientation of the light sources in ceiling fixture use or to the orientation shown in the drawings. However, these and other light sources according to the invention may of course be used, mounted, and stored in either of those orientations or in other orientations.

Figure 14:
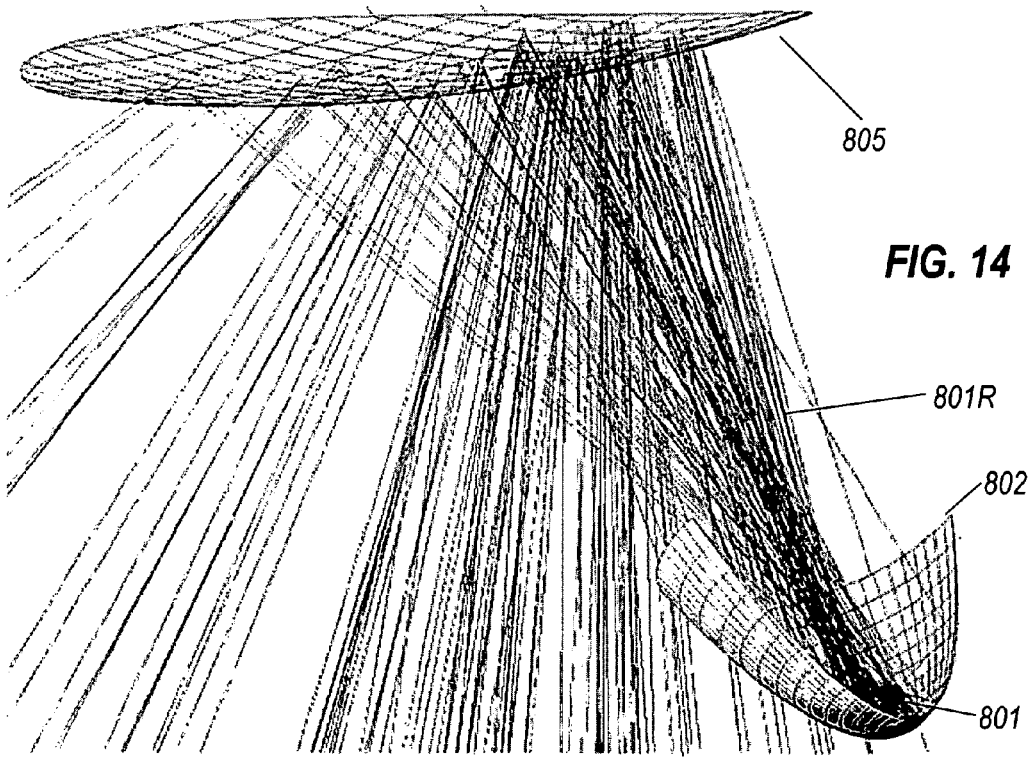
FIG. 14 is a close-up perspective view of one of the LEDs and its reflectors, showing light rays.

The light sources shown in the drawings have been described as being circular, with the LED packages and reflectors evenly spaced around the axis of the mounting cylinder. However, for some purposes, for example, a wall-sconce designed to match the embodiments shown, the LED packages and reflectors may form an incomplete ring. For example, a wall-sconce designed to match the embodiment shown in FIGS. 13 and 14 might have the cylinder 803 mounted close to the wall, and only three of the five sets of components 801, 802, 803, 805. A wall-sconce designed to match the embodiment shown in FIGS. 1 to 5, or FIG. 8, or FIG. 12 might have an incomplete mounting cylinder mounted with its open side against the wall, or in the case of a semicircular mounting cylinder with its open side against a mirror, so that the real and mirror-image halves form a complete, circular luminaire.

The mounting cylinder 103, 403, 703, 803 has been shown in the drawings as a right circular cylinder. The circular cylinder is simple to design, simple to manufacture, robust, and aesthetically pleasing. Other shapes, including a polygon or a shape intermediate between a polygon and a circle, are of course possible. To avoid redesigning the optics, a shape that maintains the even positioning of the LED packages and optics on a notional circle is preferred. In a practical embodiment, the cylinder may have a slight conical draft for ease of molding.

We claim:

1. A light source comprising a mounting cylinder having an interior surface and an exterior surface, multiple light emitters mounted on one surface of said mounting cylinder, cooling elements on the opposite surface of said mounting cylinder, and multiple reflectors each surrounding a emitter so as to prevent light from the associated emitter reaching other said reflectors, each said reflector forming a beam in the axial direction of said mounting cylinder, wherein said emitters and said reflectors are on the interior surface of said cylinder and said cooling elements on the exterior surface of said cylinder.

2. The light source of claim 1 wherein each said reflector at least partially surrounds a respective said emitter.

3. The light source of claim 1, wherein each said reflector together with part of the one surface of the mounting cylinder surrounds a respective said emitter.

4. The light source of claim 1 wherein said reflectors are double ellipsoids having different sagittal and meridional focal lengths, said ellipsoids positioned so that their foci are located nearly at said light emitters, said ellipsoids having exit apertures at one end of said mounting cylinder.

5. The reflectors of claim 4, wherein said ellipsoids have an aspheric modification that induces tailored aberrations that remove source irregularities from the beam pattern output.

6. The light source of claim 1 wherein said light emitters are electrically powered by cabling entering the opposite end of said mounting cylinder from an end towards which said beams are directed.

7. The light source of claim 1 wherein said cooling elements comprise convective fins.

8. The light source of claim 1, wherein said reflectors direct said beams of light away from an exit of said light source, further comprising secondary double ellipsoidal reflectors that redirect said beams out through said exit to form a collective pattern.

9. The light source of claim 1, wherein the emitters comprise LED chips.

10. The light source of claim 9, wherein each said emitter comprises a plurality of LED chips.

11. The light source of claim 1, wherein the emitters are hemispherical emitters, and are angled from a radial direction towards an end of said light source towards which said beams are directed.

12. The light source of claim 1 where the reflectors are specular.

13. The light source of claim 1 where the reflectors have spreading features on their surface, wherein the spreading features are sections of a sphere such that each feature produces a similar circular pattern in the far field, thereby creating the desired beam pattern by multiple overlapping of beams with the same angle and shape.

14. The light source of claim 1 where a portion of one or more reflectors is specular and a portion of one or more reflectors has spreading features.

15. The light source of claim 1, wherein each said reflector forms an asymmetrical beam of light, and wherein the asymmetrical beams and the unreflected light from said emitters combine in the far field to produce a substantially circular illumination.

16. A light source comprising a mounting cylinder having an interior and an exterior surface, multiple light emitters mounted on the exterior surface of said mounting cylinder cooling elements on the interior surface of said mounting cylinder, and multiple reflectors on the exterior surface of said cylinder surrounding said emitters, each said reflector forming a beam in the axial direction of said mounting cylinder.

17. A body for a luminaire, comprising a mounting cylinder having an interior surface and an exterior surface, cooling elements on one of the interior surface and the exterior surface of said mounting cylinder, and multiple reflectors on the opposite one of the interior surface and the exterior surface of said mounting cylinder, each said reflector oriented to form a beam in an axial direction of said mounting cylinder, each said reflector together with an associated portion of said mounting cylinder surrounding an interior space, said interior spaces being separated from one another by said reflectors.

18. A luminaire body according to claim 17, further comprising a mount for a light source within each reflector.

19. A luminaire body according to claim 17, wherein said reflectors are double ellipsoidal.

20. A light source comprising a mounting cylinder having an axis, an interior surface, and an exterior surface, multiple light emitters mounted on one of the interior surface and the exterior surface of said mounting cylinder, cooling elements on the opposite one of the interior surface and the exterior surface of said mounting cylinder, and multiple reflectors each surrounding a said emitter, each said reflector forming a reflected beam in the axial direction of said mounting cylinder, wherein: each said reflected beam is asymmetric about the axis of the mounting cylinder; the said reflected beams combine to form an illumination pattern that is generally circular and symmetric around said axis; and the reflectors are so shaped that the unreflected light emitted by each emitter is confined within the generally circular and symmetric illumination pattern.

* * * * *